US010049799B2

(12) United States Patent
Ryu et al.

(10) Patent No.: US 10,049,799 B2
(45) Date of Patent: Aug. 14, 2018

(54) MAGNETIC SHEET, METHOD FOR MANUFACTURING MAGNETIC SHEET AND ANTENNA COMPRISING THE MAGNETIC SHEET

(71) Applicant: EMW CO., LTD., Incheon (KR)

(72) Inventors: Byung Hoon Ryu, Seoul (KR); Won Mo Sung, Gyeonggi-do (KR); Won Ki Ahn, Gyeonggi-do (KR); Kwang Muk Cho, Gyeonggi-do (KR)

(73) Assignee: EMW CO., LTD., Incheon (KR)

( * ) Notice: Subject to any disclaimer, the term of this patent is extended or adjusted under 35 U.S.C. 154(b) by 267 days.

(21) Appl. No.: 14/400,048

(22) PCT Filed: May 9, 2013

(86) PCT No.: PCT/KR2013/004055

§ 371 (c)(1),
(2) Date: Nov. 10, 2014

(87) PCT Pub. No.: WO2013/169017

PCT Pub. Date: Nov. 14, 2013

(65) Prior Publication Data

US 2015/0109179 A1 Apr. 23, 2015

(30) Foreign Application Priority Data

May 10, 2012 (KR) ..... 10-2012-0049525
May 10, 2012 (KR) ..... 10-2012-0049542

(51) Int. Cl.
*H01F 1/16* (2006.01)
*H01Q 9/04* (2006.01)
(Continued)

(52) U.S. Cl.
CPC ..... *H01F 1/16* (2013.01); *H01F 41/02* (2013.01); *H01F 41/16* (2013.01); *H01Q 7/06* (2013.01);
(Continued)

(58) Field of Classification Search
None
See application file for complete search history.

(56) References Cited

U.S. PATENT DOCUMENTS 5,239,744 A * 8/1993 Fleming ..... B28B 1/48 264/272.15
6,190,516 B1 * 2/2001 Xiong ..... C23C 14/3414 148/306
(Continued)

FOREIGN PATENT DOCUMENTS

CN 104380850 A 2/2015
JP 2001-284878 A 10/2001
(Continued)

OTHER PUBLICATIONS

Office action dated Jun. 17, 2013 from Korean Intellectual Property Office (KIPO) in a counterpart Korean patent application No. 10-2012-0049525.
(Continued)

*Primary Examiner* — Kevin M Bernatz
(74) *Attorney, Agent, or Firm* — The PL Law Group, PLLC

(57) ABSTRACT

Disclosed are a magnetic sheet, a method of manufacturing the same and an antenna including the magnetic sheet. In the magnetic sheet manufactured by stacking a plurality of green sheets on top of each other and calcining the stacked plurality of green sheets, the plurality of green sheets are
(Continued)

stacked after a different material layer is formed on a certain portion of both surfaces or one surface of at least one of the plurality of green sheets.

12 Claims, 9 Drawing Sheets

(51) Int. Cl.
*H01F 41/16* (2006.01)
*H01F 41/02* (2006.01)
*H01Q 7/06* (2006.01)

(52) U.S. Cl.
CPC ..... *H01Q 9/0407* (2013.01); *Y10T 428/325* (2015.01)

(56) References Cited

U.S. PATENT DOCUMENTS 6,660,412 B2 * 12/2003 Roshen ..... B32B 7/02 174/391
6,717,794 B2 * 4/2004 Yoshikawa ..... B32B 18/00 361/321.2
6,835,463 B2 * 12/2004 Srinivasan ..... H01F 1/344 310/311
8,268,461 B1 * 9/2012 Hellwig ..... G11B 5/7325 428/831
8,725,263 B2 * 5/2014 Yamamoto ..... A61N 1/3754 607/37
9,093,218 B2 * 7/2015 Ozeki ..... H01F 1/0577
2003/0148094 A1 * 8/2003 Umemoto ..... B82Y 30/00 428/329
2006/0214855 A1 * 9/2006 Harada ..... H01Q 1/38 343/700 MS
2013/0299349 A1 * 11/2013 Kuriyama ..... C23C 14/35 204/298.17
2014/0176380 A1 * 6/2014 Choi ..... H01Q 1/38 343/787
2017/0365288 A1 * 12/2017 Foad ..... G11B 5/855
2018/0115168 A1 * 4/2018 Schatz ..... H02J 5/005

FOREIGN PATENT DOCUMENTS

JP 2008-194865 A 8/2008
JP 2009-259933 A 11/2009
JP 2015-524162 A 8/2015
KR 10-2006-0102283 A 9/2006
KR 10-0909172 B1 7/2009
WO 2013169017 A1 11/2013

OTHER PUBLICATIONS

Office action dated Jun. 17, 2013 from Korean Intellectual Property Office (KIPO) in a counterpart Korean patent application No. 10-2012-0049542.
International Search Report for PCT/KR2013/004055.

* cited by examiner

MAGNETIC SHEET, METHOD FOR MANUFACTURING MAGNETIC SHEET AND ANTENNA COMPRISING THE MAGNETIC SHEET

CROSS-REFERENCE TO RELATED APPLICATION

This application is a National Stage entry from International Application No. PCT/KR2013/004055, filed 9 May 2013, which claims priorities to and the benefit of Korean Patent Application No. 10-2012-0049525, filed on May 10, 2012 and Korean Patent Application No. 10-2012-0049542, filed on May 10, 2012, the disclosure of which is incorporated herein by reference in its entirety.

BACKGROUND

1. Field of the Invention

The present invention relates to a magnetic sheet, a method of manufacturing the same and an antenna including the magnetic sheet, and more particularly, to a magnetic sheet capable in which permeability can be adjusted using a different material layer, a method of manufacturing the same, and an antenna including the magnetic sheet.

2. Discussion of Related Art

A magnetic material is commonly used for shielding various types of electromagnetic waves or suppressing electromagnetic interference (EMI) in a wire, and also has a wide range of applications due to its various types and characteristics depending on how the constituent components thereof are synthesized. In recent years, magnetic materials have been used for RF components, such as antennas, electron microscopy cores (EMCs), power inductors, and broadband transformers.

Magnetic materials may be manufactured in the form of a thin sheet. A magnetic sheet may be manufactured in various methods, and one of the methods is achieved as follows. First, a powder is prepared using various methods, such as a solid-phase method and a wet method. Thereafter, a slurry is manufactured by mixing the powder with a binder, plasticizer, dispersant, etc. The mixed slurry is coated into a thin sheet using a doctor blade casting device, and dried. The dried sheet is generally referred to as a green sheet. Thereafter, the green sheet may be subjected to a calcination process. The calcination process may be performed on a plurality of green sheets stacked on top of each other, or a single sheet.

A magnetic material or a magnetic sheet manufactured as described above has a permeability characteristic and thus can be used for RF components. In general, a permeability value of a magnetic material depends on constituent components and a manufacturing process of the magnetic material, and thus in order to change a permeability, methods of varying constituent components of the material, or adjusting the temperature of various thermal treatments in the manufacturing process have been used. However, there is a desperate need to develop technology other than the above-described methods for easily adjusting the permeability.

In addition, the conventional technology fails to allow a different permeability value to be represented at a certain region of a single magnetic sheet. However, in some cases, various RF components each having a different function need to mounted on a single magnetic sheet, or antennas each operating at a different frequency band are mounted on a single magnetic sheet. Therefore, to apply a different permeability value at each component, there is a need for technology for adjusting a permeability value of only a certain portion of a magnetic sheet.

SUMMARY OF THE INVENTION

The present invention is directed to a technology with which a permeability value of a magnetic sheet can be easily adjusted by adding a process of forming a different material layer on a green sheet.

The present invention is directed to a technology capable of allowing a different permeability value to be represented only at a certain portion of a magnetic sheet.

The present invention is directed to an antenna obtained by attaching a radiating material to a magnetic sheet in which certain portions represent different permeability values.

According to an aspect of the present invention, there is provided a magnetic sheet manufactured by stacking a plurality of green sheets on top of each other and calcining the stacked plurality of green sheets, in which the plurality of green sheets are stacked after a different material layer is formed on a certain portion of both surfaces or one surface of at least one of the plurality of green sheets.

The different material layer may be formed by coating a paste obtained by mixing a different material powder and an organic solvent.

The different material layer may include a cobalt component.

The different material layer may be formed by coating a cobalt paste on a certain portion of both surfaces or one surface of at least one of the plurality of green sheets.

The cobalt paste may be obtained by mixing at least one of cobalt(II) oxide (CoO), cobalt(III) oxide ($Co_2O_3$), cobalt (IV) oxide ($CoO_2$), and tricobalt tetraoxide ($Co_3O_4$) with an organic solvent.

According to another aspect of the present invention, there is provided a method of manufacturing a magnetic sheet by stacking a plurality of green sheets on top of each other and calcining the stacked plurality of green sheets, the method including: forming a different material layer on a certain portion of both surfaces or one surface of at least one of the plurality of green sheets before stacking the plurality of green sheets on top of each other.

The different material layer may be formed by coating a paste obtained by mixing a different material powder with an organic solvent.

The different material layer may include a cobalt component.

The different material layer may be formed by coating a cobalt paste on a certain portion of both surfaces or one surface of at least one of the plurality of green sheets.

The cobalt paste may be obtained by mixing at least one of cobalt(II) oxide (CoO), cobalt(III) oxide ($Co_2O_3$), cobalt (IV) oxide ($CoO_2$), and tricobalt tetraoxide ($Co_3O_4$) with an organic solvent.

According to another aspect of the present invention, there is provided an antenna including: the magnetic sheet; a first radiating material attached to a projection surface of the magnetic sheet corresponding to a region of the green sheet in which the different material layer is formed; and a second radiating material attached to a projection surface of the magnetic sheet corresponding to a region of the green sheet in which the different material layer is not formed.

According to another aspect of the present invention, there is provided a magnetic sheet manufactured by stacking a plurality of green sheets on top of each other and calcining the stacked plurality of green sheets, wherein the plurality of green sheets are stacked after a different material layer is formed on both surfaces or one surface of at least one of the plurality of green sheets, wherein the different material layer may include: a first layer formed on a certain portion of both surfaces or one surface of at least one of the plurality of green sheets; and a second layer formed of a component different from a component constituting the first layer, and formed on another certain portion of both surfaces or one surface of at least one of the plurality of green sheets on which the first layer is not formed.

The different material layer may be formed by coating a paste obtained by mixing a different material powder with an organic solvent.

According to an aspect of the present invention, there is provided a method of manufacturing a magnetic sheet by stacking a plurality of green sheets on top of each other and calcining the stacked plurality of green sheets, the method including: forming a different material layer on both surfaces or one surface of at least one of the plurality of green sheets before stacking the plurality of green sheets on top of each other, wherein the different material layer includes: a first layer formed on a certain portion of both surfaces or one surface of at least one of the plurality of green sheets; and a second layer formed of a component different from a component constituting the first layer, and formed on another certain portion of both surfaces or one surface of at least one of the plurality of green sheets on which the first layer is not formed.

The different material layer may be formed by coating a paste obtained by mixing a different material powder with an organic solvent.

According to another aspect of the present invention, there is provided an antenna including: the magnetic sheet; a first radiating material attached to a projection surface of the magnetic sheet corresponding to a region of the green sheet in which the first layer is formed; and a second radiating material attached to a projection surface of the magnetic sheet corresponding to a region of the green sheet in which the second layer is formed.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Exemplary embodiments of the present invention will be described in detail below with reference to the accompanying drawings. While the present invention is shown and described in connection with exemplary embodiments thereof, it will be apparent to those skilled in the art that various modifications can be made without departing from the spirit and scope of the invention.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Hereinafter, various exemplary embodiments of the present invention will be described in detail with reference to the accompanying drawings. In the description of the embodiments, the detailed description of related known functions or constructions will be omitted herein to avoid making the subject matter of the embodiment ambiguous.

Figure 1:
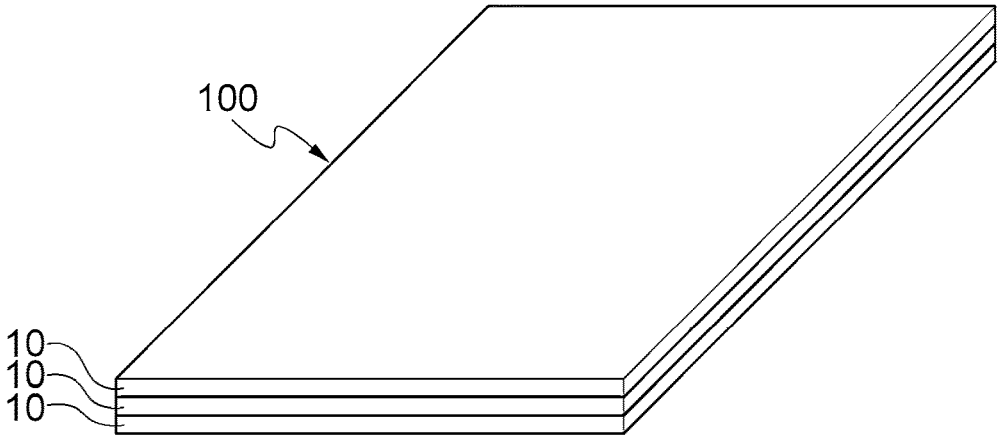
FIG. 1 is a perspective view illustrating a magnetic sheet according to the first exemplary embodiment of the present invention.

FIG. 1 is a perspective view illustrating a magnetic sheet according to the first exemplary embodiment of the present invention.

Referring to FIG. 1, a magnetic sheet 100 according to the first exemplary embodiment of the present invention may be manufactured in a multilayer form by stacking a plurality of green sheets 10 on top of each other, and then calcining the stacked green sheets 10.

When the magnetic sheet 100 in the multilayer form is manufactured, the stacked plurality of green sheets 10 are generally formed of the same material. However, if the magnetic sheet 100 is manufactured by only using the same material, there is a limitation in adjusting a permeability of the finally obtained magnetic sheet 100. That is, according to the conventional technology, in order to adjust permeability characteristic of the magnetic sheet 100, chemical components of a magnetic material need to be adjusted in advance. For example, according to an intention of a manufacturer, a chemical component such as Ni—Zn ferrite, Mn—Zn ferrite, and Ni—Zn—Cu ferrite may be selected in advance, and used in manufacturing the magnetic sheet 100.

Another technology for adjusting permeability is to stack green sheets 10 of different materials rather than using the green sheets 10 of the same material. That is, when the green sheets 10 each formed of a different material are stacked on top of each other, the permeability may be adjusted by changing the stacking order or changing the material of the stacked green sheet 10. However, when the green sheets 10 of different materials are stacked on top of each other, there is difficulty in a bonding process difference in contraction, which complicates the manufacturing process. Accordingly, the technology of manufacturing the magnetic sheet 100 by stacking the green sheets 10 of different materials on top of each other is simple in concept, but there are various practical constraints in implementing the concept.

The magnetic sheet 100 according to the first exemplary embodiment of the present invention 100 is provided to resolve the above described limitations. Hereinafter, the present invention will be described in relation to the embodiments in detail.

First, the magnetic sheet 100 according to the first exemplary embodiment of the present invention will be described.

The magnetic sheet 100 according to the first exemplary embodiment of the present invention is manufactured by partially forming a different material layer 20 on at least one of a plurality of green sheets 10, stacking the plurality of green sheets 10 and calcining the plurality of green sheets 10. That is, the different material layer 20 is formed on a certain portion of both surfaces or one surface of at least one of the plurality of green sheets 10 before stacking the plurality of green sheets 10, and then the plurality of green sheets 10 are stacked and calcined.

Figure 2:
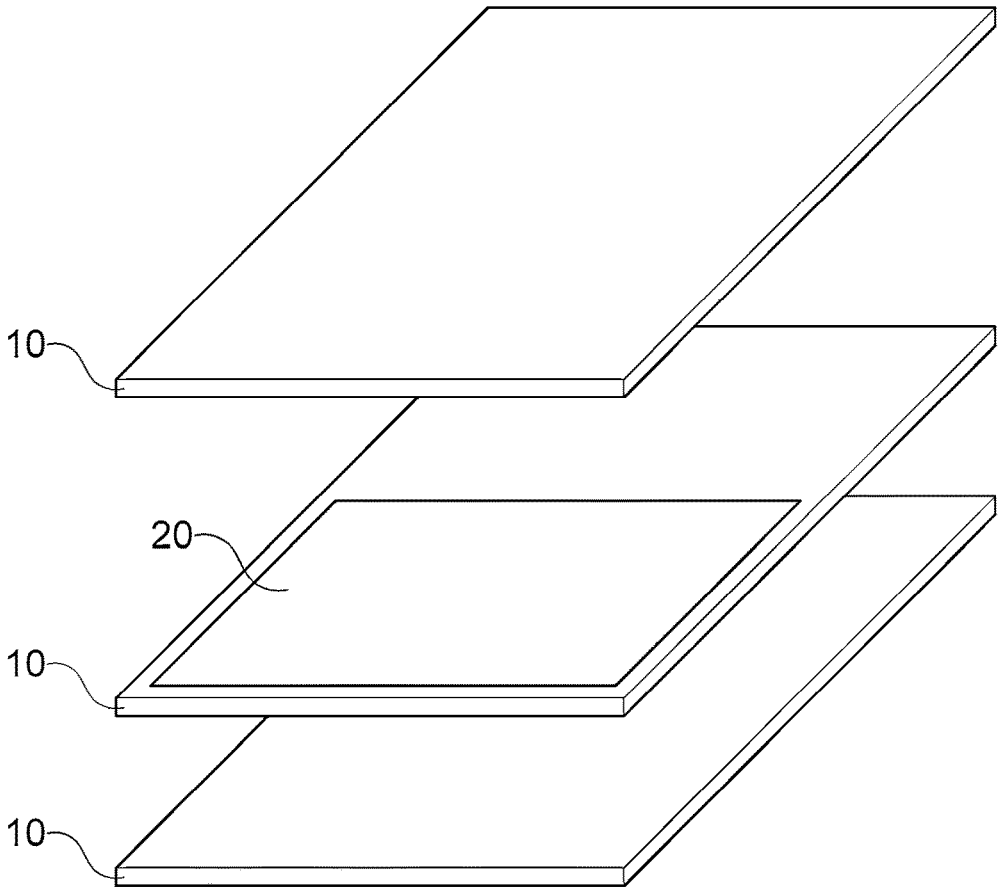
FIG. 2 is an exploded perspective view illustrating a magnetic sheet according to the first exemplary embodiment of the present invention, which shows the magnetic sheet in an exploded state before green sheets are stacked on top of each other.

FIG. 2 is an exploded perspective view illustrating a magnetic sheet according to the first exemplary embodiment of the present invention, which shows the different material layer 20 formed on a certain portion of an upper surface of the green sheet 10. The different material layer 20 is formed on at least one of the plurality of green sheets 10, and is not necessarily formed on only one of the plurality of green sheets 10. That is, the different material layer 20 may be formed on one or more green sheets 10. In addition, the different material layer 20 is formed on both surfaces or one surface of the green sheet 10. Although the different material layer 20 is illustrated as being formed on an upper surface of the green sheet 10 in FIG. 2, the different material layer 20 may be formed on both of the upper surface and the lower surface or only on the lower surface of the green sheet 10.

The different material layer 20 formed on only a certain portion of the green sheet is useful in adjusting the permeability in a portion of the finally obtained magnetic sheet 100. That is, a projection surface corresponding to a region of the magnetic sheet 100 in which the different material layer 20 is formed has a permeability different from that of a projection surface corresponding to a region of the magnetic sheet 100 in which the different material layer 20 is not formed. Accordingly, the above structure is used to implement different permeability characteristics on the same magnetic sheet 100.

The different material layer 20 is formed by a paste coating method. In detail, the different material layer 20 is formed by coating a paste obtained by mixing a powder formed of a material different from that constituting the green sheet 10 to be coated with an organic solvent. In this case, the coating refers to application to an outside of one surface or both surfaces of the green sheet 10. The coating may be performed using a printing scheme, such as silk-screen printing.

As the green sheet 10 having a paste coated thereon is stacked and calcined, the component of the different material powder naturally penetrates into the magnetic sheet 10 and is dispersed. The permeability of the magnetic sheet 100 is adjusted by the dispersed different material component. Accordingly, it is preferable to manufacture the paste by selecting an organic solvent capable of effectively dispersing the different material.

In order to adjust the permeability in more detail, the type or the contents of components constituting the different material layer 20 may be adjusted. Alternatively, the detailed adjustment of the permeability may be achieved by adjusting the thickness of the different material layer 20. For example, when the different material layer 20 is coated in the form of a paste, the permeability may be adjusted by changing the number of coatings. In addition, the different material layer 20 may include a cobalt (Co) component. As the different material layer 20 including a cobalt component is formed on one surface of the green sheet 10, and the green sheet 10 having the different material layer 20 is stacked and calcined, the permeability value of the finally obtained green sheet 100 is lowered.

Figure 3:
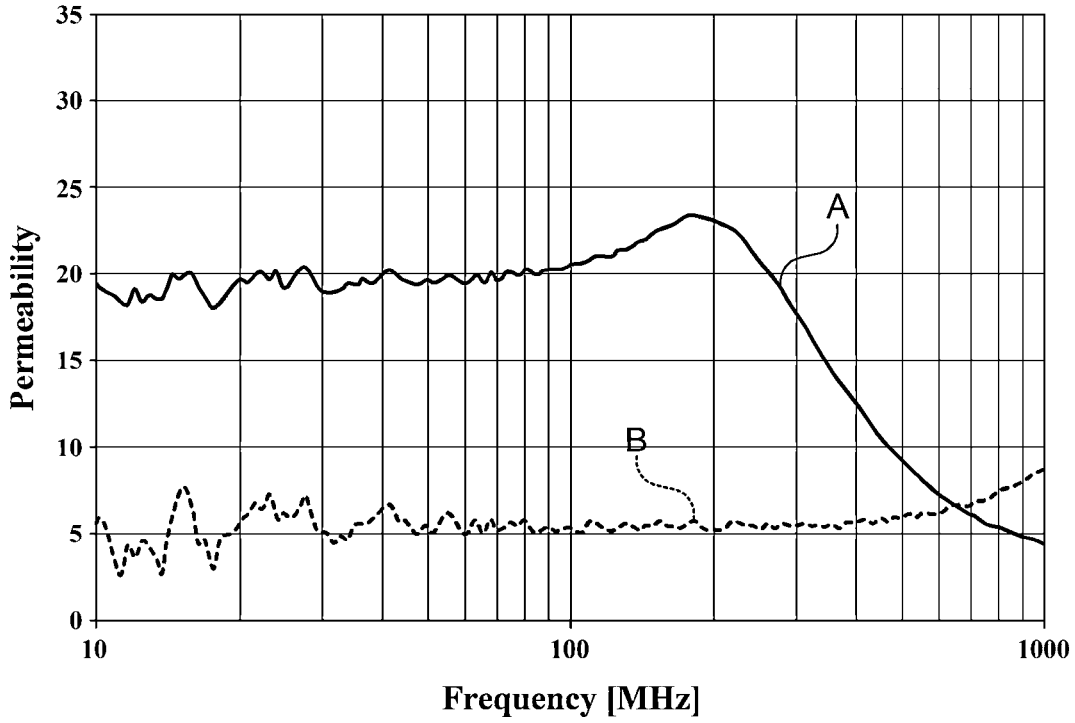
FIG. 3 is a graph showing a permeability value of a magnetic sheet according to the first exemplary embodiment of the present invention relative to frequency.

That is, when a cobalt (Co) paste is used as an example of a paste including a mixture of a different material powder and an organic solvent, a portion on which the paste is coated has a lowered permeability. Such a feature is shown in FIG. 3. A portion indicated as 'A' in FIG. 3 represents a permeability of a portion not having the different material layer 20, which reaches about 20 in a range of 10 to 100 MHz. A portion indicated as 'B' in FIG. 3 represents a permeability of a portion having the different material layer 20 including a cobalt component, which reaches about 5. That is, according to the above experiment, it is proved that B has a permeability lower than that of A.

When the different material layer 20 is formed, a cobalt paste coating method may be adopted in order to include a cobalt component in the different material layer 20. The cobalt paste may be manufactured by selecting at least one of cobalt(II) oxide (CoO), cobalt(III) oxide ($Co_2O_3$), cobalt (IV) oxide ($CoO_2$), and tricobalt tetraoxide ($Co_3O_4$), or a combination thereof. That is, the cobalt component prepared in the form of a powder is mixed with an organic solvent to form a paste and the cobalt paste is coated on the green sheet 10. The coating refers to application to outside of one surface or both surfaces of the green sheet 10. The coating may be performed using a printing scheme, such as silk-screen printing.

By using the cobalt paste, the cobalt component naturally penetrates into the magnetic sheet 10 during thermal treatment of the stacked plurality of green sheets 10 and is dispersed. The permeability of the magnetic sheet 100 is adjusted by the dispersed cobalt component. Accordingly, it is preferable to manufacture the cobalt paste by selecting an organic solvent capable of effectively dispersing the cobalt powder.

The above description of the cobalt component is provided only as an example, and the different material layer 20 according to the present invention need not include a cobalt component. That is, an application such as allowing the different material layer 20 to include components other than the cobalt component may fall within the scope of the invention. For example, the different material layer 20 may be formed by coating a different type of ferrite from the green sheet 10, or may be formed by manufacturing a paste using a metal powder other than a cobalt powder. Such an application may vary depending on the design intention of a manufacturer manufacturing the magnetic sheet.

Figure 4:
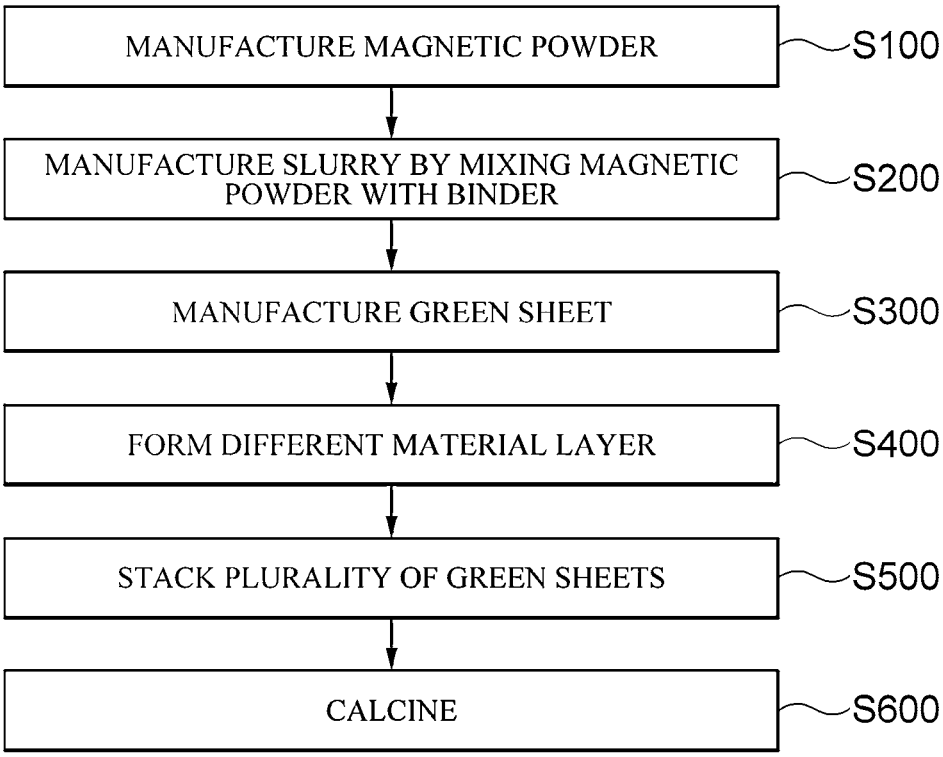
FIG. 4 is a flow chart showing a method of manufacturing a magnetic sheet according to the first exemplary embodiment of the present invention.

Hereinafter, a method of manufacturing a magnetic sheet according to the first exemplary embodiment of the present invention will be described with reference to FIG. 4.

According to the first exemplary embodiment of the present invention, a magnetic powder is manufactured (S100), and a slurry is manufactured by mixing the manufactured magnetic powder with a binder, a plasticizer and a dispersant (S200). The magnetic powder may be provided using Ni—Zn ferrite, Mn—Zn ferrite, and Ni—Zn—Cu ferrite, but is not limited thereto. That is, other types of magnetic powders may be used depending on the intention of a manufacturer. Meanwhile, the slurry mixture is processed into the green sheet 10 using a doctor blade casting device (S300). The magnetic sheet manufacturing method according to the present invention includes forming the different material layer 20 on both surfaces or one surface of at least one of a plurality of processed green sheets 10 before stacking the plurality of processed green sheets 10 (S400). Once the different material layer 20 is formed, the plurality of green sheets 10 are stacked (S500), and calcined (S600), thereby completing manufacture of the magnetic sheet 100.

In order to manufacture the magnetic sheet 100 according to the first embodiment of the present invention, the different material layer 20 is formed only on a certain portion of the green sheet 10 in operation S400 of forming the different material layer 20. The description of the different material layer 20, which is formed on a certain portion, is identical to the above description, and a cobalt paste manufactured from at least one selected from cobalt(II) oxide (CoO), cobalt(III) oxide ($Co_2O_3$), cobalt(IV) oxide ($CoO_2$), and tricobalt tetraoxide ($Co_3O_4$), or a combination thereof may be coated in order to include a cobalt component in the different material layer 20. Therefore, detailed description of the cobalt paste coating will be omitted.

Hereinafter, an antenna will be described as an example of application of the magnetic sheet according to the first exemplary embodiment of the present invention.

Figure 5A:
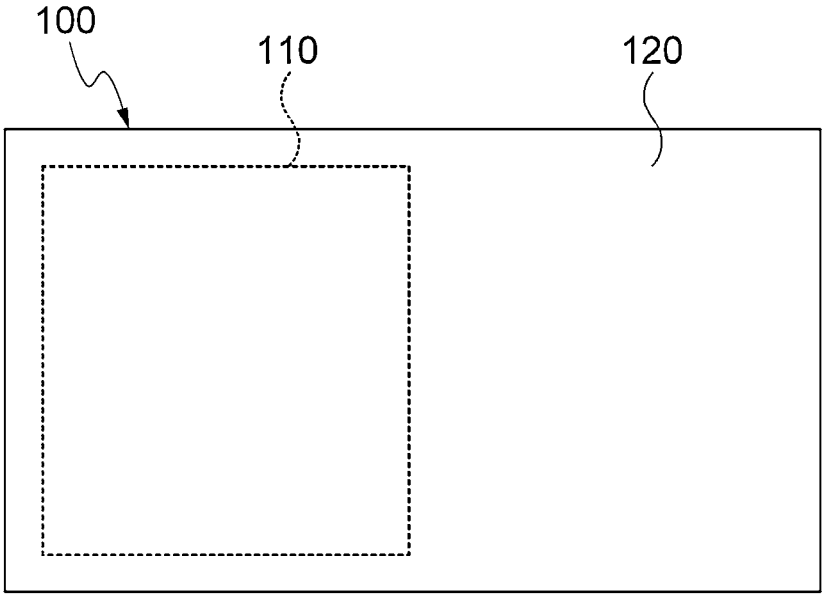
FIG. 5 shows plan views illustrating a magnetic sheet according to the first exemplary embodiment of the present invention and an example of an antenna including the magnetic sheet.
Figure 5B:
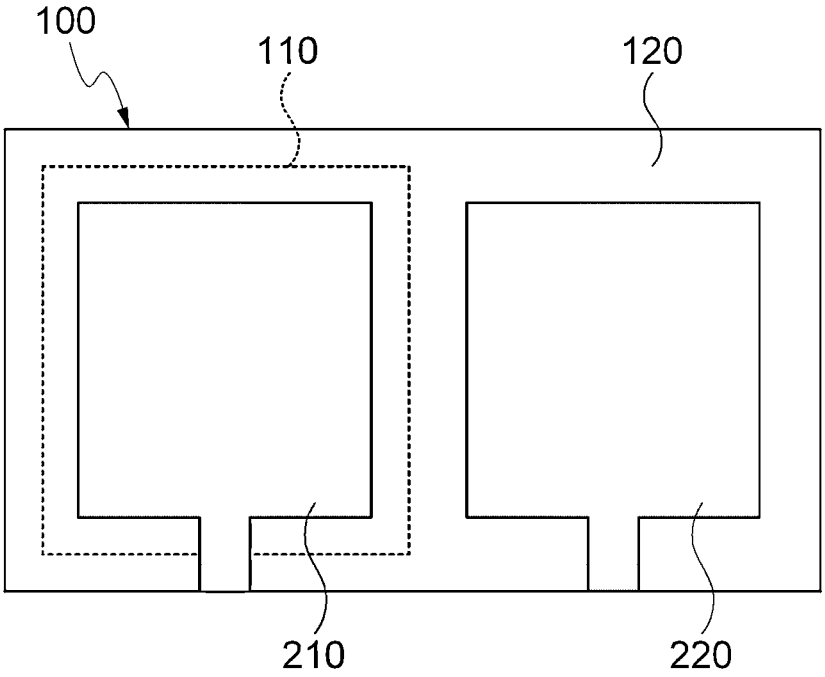

(a) of FIG. 5 is a plan view illustrating a magnetic sheet according to the first exemplary embodiment of the present invention, and (b) of FIG. 5 is a plan view illustrating an example of an antenna including a magnetic sheet according to the first exemplary embodiment of the present invention.

A magnetic sheet attachment type antenna varies characteristics thereof, such as a resonant frequency, a gain and a bandwidth, depending on the permeability of the magnetic sheet 100. In particular, the demand of the magnetic sheet attachment type antenna has been increasing for near field communication (NFC), and depending on situations, a plurality of radiating materials may be attached to a single magnetic sheet 100. A plurality of radiating materials may be attached to allow operation at different frequency bands or implementation of various functions.

In particular, the magnetic sheet 100 may need to have different permeability values at different portions in order for each radiating material to operate optimally. Since the permeability value and the permeation loss value of the magnetic sheet vary with the frequency band, an environment suitable for a radiating material operating at a first frequency band may not be suitable for a radiating material operating at a second frequency band.

As shown in (a) of FIG. 5, the magnetic sheet 100 according to the first exemplary embodiment of the present invention may be divided into a region 110 in which the different material layer is formed and a region 120 in which the different material layer is not formed. That is, when considered in a plan view, the magnetic sheet 100 is divided into a projection surface corresponding to the region 110 in which the different material layer is formed, and the region 120 in which the different material layer is not formed.

Referring to (b) of FIG. 5, an example of the antenna including the magnetic sheet 100 according to the first exemplary embodiment of the present invention, a first radiating material 210 and a second radiating material 220 is provided. The first radiating material 210 is attached to a projection surface of the magnetic sheet 100 corresponding to the region 110 in which the different material layer is formed. The second radiating material 220 is attached to a projection surface of the magnetic sheet 100 corresponding to the region 120 in which the different material layer is not formed. Such a construction produces a benefit that the permeability values of the magnetic sheet 100 applied to the first radiating material 210 and the second radiating material 220 are independently selected.

Meanwhile, although a total of two of the radiating materials are illustrated, the number of radiating materials is not limited and more than two radiating materials may be provided. In addition, the region 110 in which the different material layer is formed may have various shapes, and may be provided in various positions. As shown in FIG. 5, the region 110 in which the different material layer is formed may be provided in a rectangular shape and take up almost half of the region of the green sheet. Alternatively, the region 110 in which the different material layer is formed may be disposed at the center of the green sheet, and the region 120 in which the different material layer is not formed may be provided in a shape surrounding the center. However, these shapes are provided only as an example, and the regions may be variously changed depending on the intention of an antenna designer.

The first radiating material 210 and the second radiating material 220 may be provided in various shapes, such as a spiral shape, a meander shape, and a loop shape, depending on the intention of an antenna designer. The first radiating material 210 and the second radiating material 220 operating as a radiating material of an antenna may be used for different purposes and at different frequency bands, or may be used for the same purpose and at the same frequency band. When the first radiating material 210 and the second radiating material 220 are used for different purposes and at different frequency bands, the first radiating material 210 may be used as a radiating material for NFC, and the second radiating material 220 may be used as a radiating material for a wireless charging. In addition, the purposes of the first radiating material 210 and the second radiating material 220 may be switched. These purposes are provided only as an example, and may be changed depending on the intention of an antenna designer.

Hereinafter, the magnetic sheet 100 according to the second exemplary embodiment of the present invention will be described.

The magnetic sheet 100 according to the second exemplary embodiment of the present invention is manufactured by forming the different material layer 20 on at least one of the plurality of green sheets 10, stacking the plurality of green sheets 10 and calcining the stacked plurality of green sheets. That is, the different material layer 20 is formed on a certain portion of both surfaces or one surface of at least one of the plurality of green sheets 10 before stacking the plurality of green sheets 10 on top of each other, and then the plurality of green sheets 10 are stacked on top of each other and calcined. The different material layer 20 includes a first layer 21 and a second layer 22. The first layer 21 is formed on a certain portion of both surfaces or one surface of at least one of the plurality of green sheets 10, and the second layer 22 is formed on another certain portion of the plurality of green sheets 10 in which the first layer 21 is not formed. The first layer 21 and the second layer 22 are formed of different components from each other.

Figure 6:
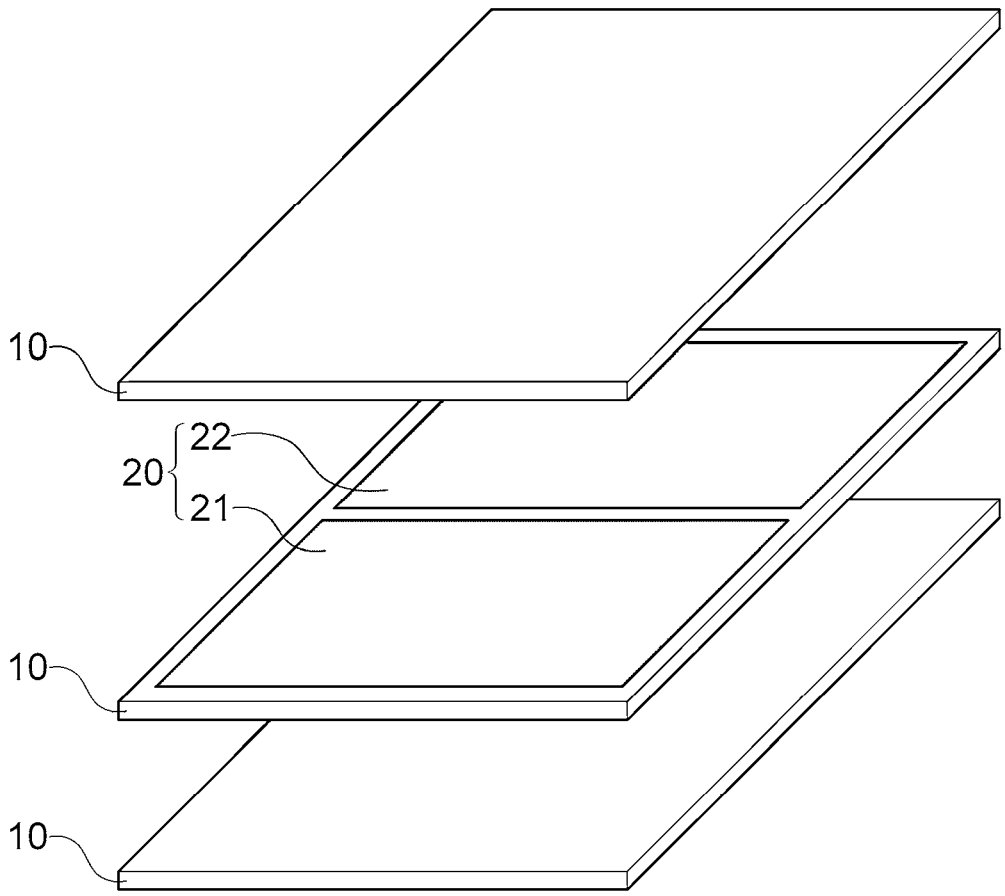
FIG. 6 is an exploded perspective view illustrating a magnetic sheet according to the second exemplary embodiment of the present invention, which shows the magnetic sheet in an exploded state before green sheets are stacked on top of each other.

FIG. 6 is an exploded perspective view illustrating a magnetic sheet according to the second exemplary embodiment of the present invention, which shows that the first layer 21 and the second layer 22 are formed at some regions of an upper surface of the green sheet 10. The first layer 21 and the second layer 22 are formed on at least one of the plurality of green sheets 10, and the first layer 21 and the second layer 22 need not be formed on the same green sheet 10. That is, the first layer 21 and the second layer 22 may be formed on one or more green sheets 10. In addition, the first layer 21 and the second layer 22 may be formed on both surfaces or one surface of the green sheet 10. Although the first layer 21 and the second layer 22 are illustrated as being formed only on the upper surface of the green sheet 10 in FIG. 6, the first layer 21 and the second layer 22 may be formed on both of an upper surface and a lower surface of the green sheet 10 or only on a lower surface of the green sheet 10.

The different material layer 20, including the first layer 21 and the second layer 22 formed separately from each other, allows the permeability of the finally obtained magnetic sheet 100 to be partially adjusted. A projection surface corresponding to a region in which the first layer 21 is formed has a measured permeability different from that of a projection surface corresponding to a region in which the second layer 22 is formed. Accordingly, such a structure may be used in order to implement different permeability values in a single magnetic sheet 100.

The different material layer 20 may be formed by a paste coating method. Application and details thereof are identical to those described in the first exemplary embodiment, and thus details thereof will be omitted in the following description.

Hereinafter, a method of manufacturing a magnetic sheet according to the second exemplary embodiment of the present invention will be described with reference to FIG. 4.

According to the second exemplary embodiment of the present invention, a magnetic powder is manufactured (S100), and a slurry is manufactured by mixing the manufactured magnetic powder with a binder, a plasticizer and a dispersant (S200). The magnetic powder may be provided using Ni—Zn ferrite, Mn—Zn ferrite, and Ni—Zn—Cu ferrite, but is not limited thereto. That is, other types of magnetic powders may be used depending on the intention of a manufacturer. Meanwhile, the slurry mixture is processed into the green sheet 10 using a doctor blade casting device (S300). The magnetic sheet manufacturing method according to the present invention includes forming the different material layer 20 on both surfaces or one surface of at least one of a plurality of processed green sheets 10 before stacking the plurality of processed green sheets 10 (S400). Once the different material layer 20 is formed, the plurality of green sheets 10 are stacked (S500) and calcined (S600), thereby completing manufacture of the magnetic sheet 100.

In order to manufacture the magnetic sheet 100 according to the second exemplary embodiment of the present invention, the first layer 21 and the second layer 22 are formed in operation S400 of forming the different material layer 20. The structure of the first layer 21 separately formed from the second layer 22 has been described above, and detailed description thereof will be omitted.

Hereinafter, an antenna will be described as an example of application of the magnetic sheet according to the second exemplary embodiment of the present invention.

Figure 7A:
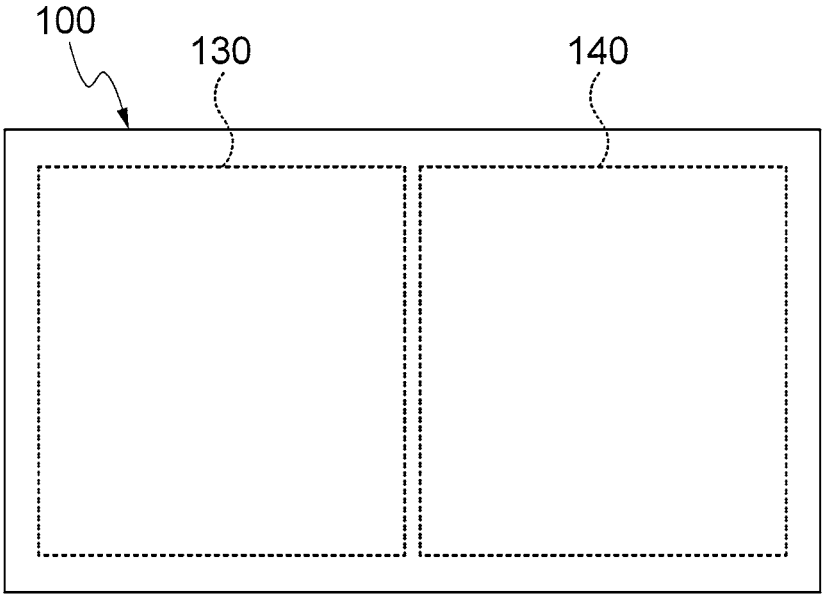
FIG. 7 shows plan views illustrating a magnetic sheet according to the second exemplary embodiment of the present invention and an example of an antenna including the magnetic sheet.
Figure 7B:
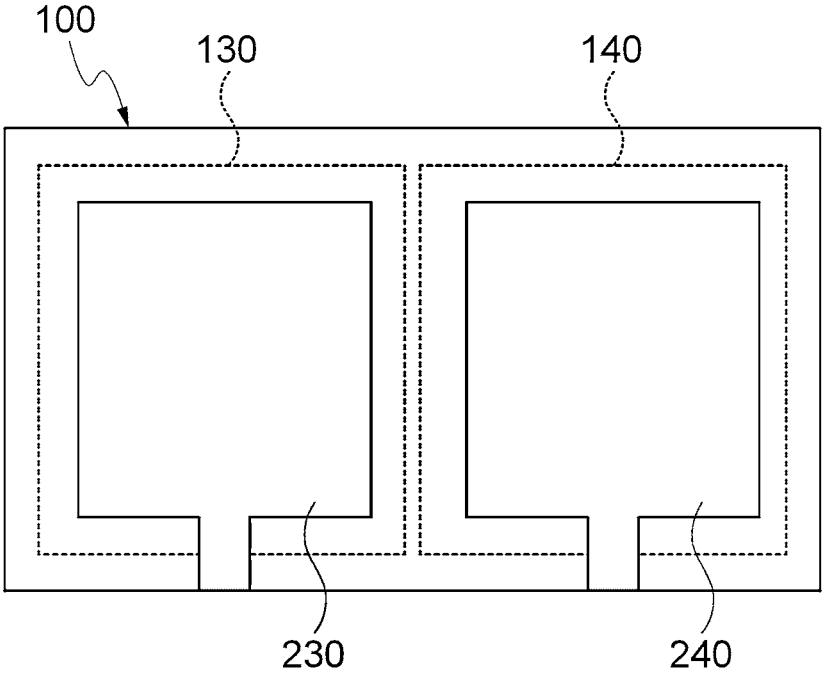

(a) of FIG. 7 is a plan view illustrating a magnetic sheet according to the second exemplary embodiment of the present invention, and (b) of FIG. 7 is a plan view illustrating an example of an antenna including a magnetic sheet according to the second exemplary embodiment of the present invention.

Similar to the description in the first exemplary embodiment of the present invention, a magnetic sheet attachment type antenna may have a plurality of radiating materials for operation at different frequency bands or implementation of various functions. In order for each radiating material to operate optimally, the magnetic sheet 100 may need to have different permeability values at different portions. Since the permeability value and the permeation loss value of the magnetic sheet vary with the frequency band, an environment suitable for a radiating material operating at a first frequency band may be not suitable for a radiating material operating at a second frequency band.

As shown in (a) of FIG. 7, the magnetic sheet 100 according to the second exemplary embodiment of the present invention may be divided into a region 130 in which the first layer is formed and a region 140 in which the second layer is formed. That is, when considered in a plan view, the magnetic sheet 100 is divided into a projection surface corresponding to the region 130 in which the first layer is formed, and the region 140 in which the second layer is formed.

Referring to (b) of FIG. 7, an example of the antenna including the magnetic sheet 100 according to the second exemplary embodiment of the present invention, a first radiating material 230 and a second radiating material 240 is provided. The first radiating material 230 is attached to a projection surface of the magnetic sheet 100 corresponding to the region 130 in which the first layer is formed. The second radiating material 240 is attached to a projection surface of the magnetic sheet 100 corresponding to the region 140 in which the second radiating layer is formed. Such a construction produces benefit that the permeability values of the magnetic sheet 100 to apply at the first radiating material 230 and the second radiating material 240 are selected independently.

Meanwhile, the number and the shape of radiating materials may be changed depending on the intention of a designer. In addition, the shapes and positions of the regions 130 and 140 in which the first layer and the second layer are formed may be changed depending on the intention of a designer. In addition, a region other than the regions 130 and 140 in which the first layer the second layer are formed may be utilized as a third region having a different permeability. That is, it should be understood that a magnetic sheet having a combined structure of the first exemplary embodiment and the second exemplary embodiment may be manufactured.

Hereinafter, various examples of application will be described with reference to FIGS. 8 to 10.

Figure 8:
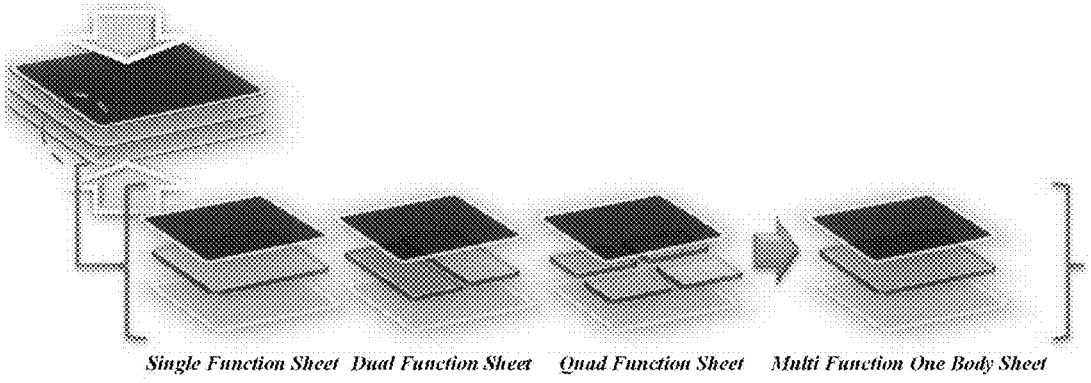
FIG. 8 is an exploded perspective view illustrating magnetic sheets according to various exemplary embodiments of the present invention, which shows the magnetic sheets in an exploded state before green sheets are stacked on top of each other.

FIG. 8 is an exploded perspective view illustrating magnetic sheets according to various exemplary embodiments of the present invention, which shows the magnetic sheet in an exploded state before green sheets are stacked on top of each other. In FIG. 8, various structures of the magnetic sheet are shown, in which the number of regions each having a different permeability, that is, the number of different material layers provided, is 1, 2 or 4. Referring to FIG. 8, the magnetic sheet may be manufactured in a form having a single different material layer (a single function sheet), two different material layers (a dual function sheet), and four different material layers (a quad function sheet). Each different material layer is functionally separated to implement a different permeability value, but is structurally included in a single sheet. Accordingly, the magnetic sheet shown in FIG. 8 may be referred to as a multi function one body sheet.

Figure 9:
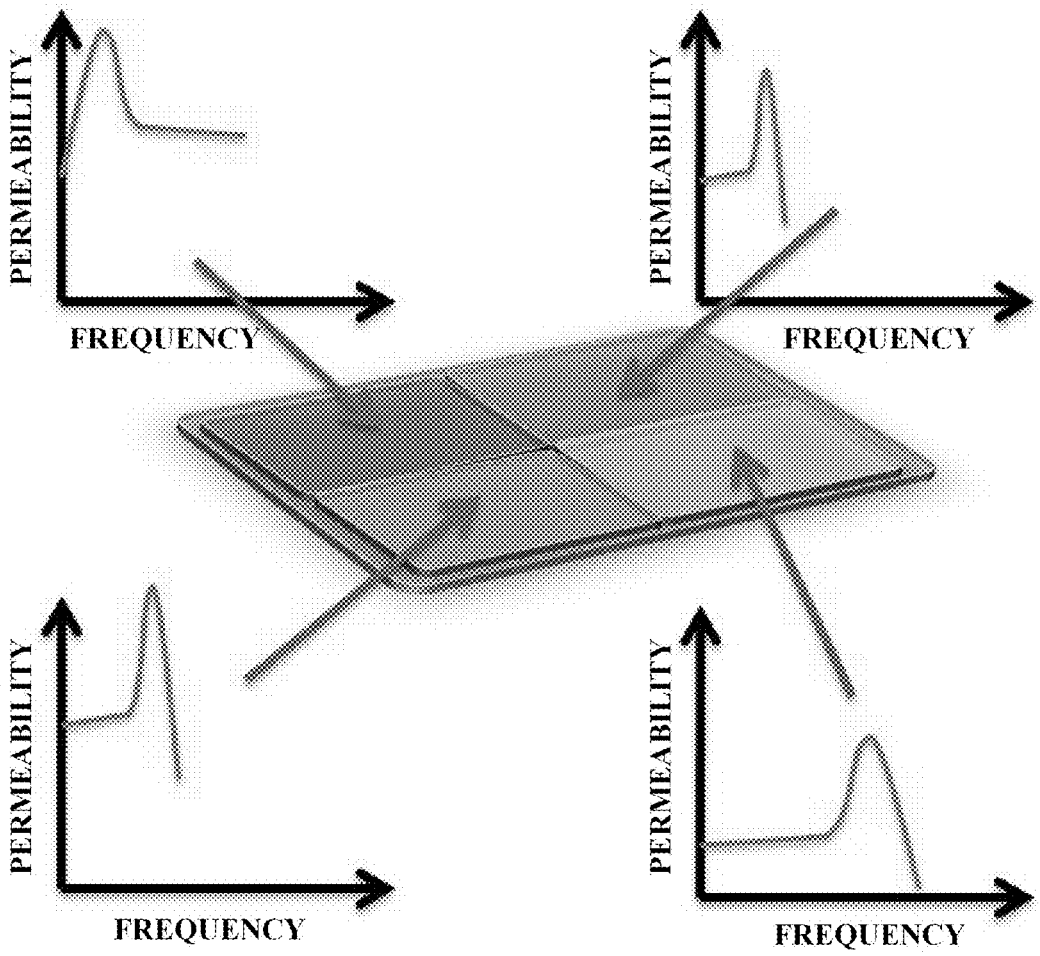
FIG. 9 is a view for describing a permeability value of a magnetic sheet according to the third exemplary embodiment of the present invention sheet relative to frequency.

FIG. 9 shows a permeability value of a magnetic sheet according to the third exemplary embodiment of the present invention relative to a frequency. In the quad function sheet in which the different material layer is divided into four different layers, each divided region shows a different change in permeability. Such a sheet structure ensures that four regions each have a different permeability value relative to frequency. Four graphs are provided in different shaped curves in FIG. 9, and each region of the sheet is used for a different purpose.

Figure 10:
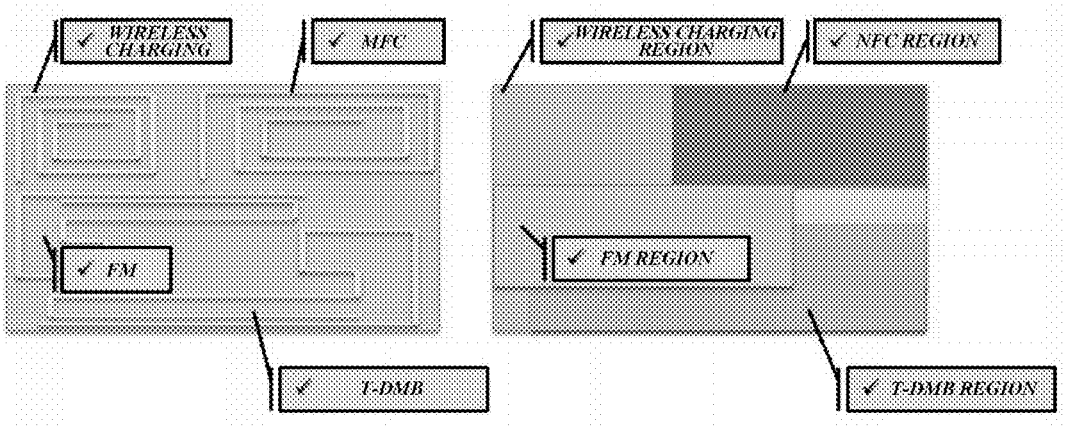
FIG. 10 shows plan views illustrating a magnetic sheet according to the fourth exemplary embodiment of the present invention and an example of an antenna including the magnetic sheet.

FIG. 10 is a plan view illustrating a magnetic sheet according to the fourth exemplary embodiment of the present invention, and an example of an antenna including the magnetic sheet, which provides another structure that may be applied to a product. According to the fourth exemplary embodiment of the present invention, an antenna operating at various service frequency bands, such as wireless charging, NFC, FM, and T-DMB, is provided. In order to implement such various functions in a single magnetic sheet, the electrical length of the antenna needs to vary with the operating frequency band, and the permeability value of each portion of the magnetic sheet needs to be different depending on the frequency band of each antenna. Accordingly, as shown in FIG. 10, antennas each having a different electrical length and a different shape are provided, and different material layers are provided such that each region of the magnetic sheet, to which each antenna is attached, has a different permeability. That is, when n antennas are included, the different material layers may be provided as n different layers. The technical feature of the present invention is not limited thereto, and according to an alternative example, antennas with similar operating frequency bands may be provided to share a single layer. In addition, according to an alternative example, when it is desired for a single antenna radiating material to operate at two or more service frequencies, the single antenna radiating material may be provided to be in contact with two or more layers.

As described above, according to the present invention, a permeability value of a magnetic sheet can be easily adjusted by adding a process of forming a different material layer on a green sheet.

In addition, according to the present invention, a different permeability value can be represented at a certain region of the magnetic sheet.

Although the above description has been made in relation to exemplary embodiments of the present invention with reference to the accompanying drawings, terms used in the specification and claims should not be interpreted as having a meaning defined in commonly used in dictionaries but a meaning that is consistent with their meaning in the context of the relevant art The exemplary embodiments disclosed in the specification and the configuration illustrated in the drawings are provided only as the most preferred embodiment of the present invention. Therefore, it will be apparent to those skilled in the art that various modifications can be made to the above-described exemplary embodiments of the present invention without departing from the spirit or scope of the invention. Thus, it is intended that the present invention cover all such modifications provided they come within the scope of the appended claims and their equivalents.

What is claimed is:

1. A magnetic sheet manufactured by stacking a plurality of green sheets on top of each other and calcining the stacked plurality of green sheets, in which the plurality of green sheets are stacked after a different material layer is formed, wherein the different material layer includes:

a first layer formed of a first component on a first portion, but not over a second component, of at least one surface of at least one of the plurality of green sheets; and a second layer formed of the second component on a second portion, but not over the first component, of said at least one surface on which the first layer is formed, said second portion being different from said first portion, the first component being different from the second component, wherein a region of the magnetic sheet in which the first layer is formed has a first permeability value adjusted by the first component, and a region of the magnetic sheet in which the second layer is formed has a second permeability value different from the first permeability value and adjusted by the second component.

2. The magnetic sheet of claim 1, wherein at least one of the first layer and the second layer is formed by coating a paste obtained by mixing a different material powder and an organic solvent.

3. The magnetic sheet of claim 1, wherein at least one of the first layer and the second layer includes a cobalt component.

4. The magnetic sheet of claim 3, wherein at least one of the first layer and the second layer is formed by coating a cobalt paste on a certain portion of both surfaces or one surface of at least one of the plurality of green sheets.

5. The magnetic sheet of claim 4, wherein the cobalt paste is obtained by mixing at least one of cobalt(II) oxide (CoO), cobalt(III) oxide ($Co_2O_3$), cobalt(IV) oxide ($CoO_2$), and tricobalt tetraoxide ($Co_3O_4$) with an organic solvent.

6. An antenna comprising:

the magnetic sheet of claim 1 a first radiating material attached to a projection surface of the magnetic sheet corresponding to a region of the green sheet in which the different material layer is formed; and a second radiating material attached to a projection surface of the magnetic sheet corresponding to a region of the green sheet in which the different material layer is not formed.

7. A method of manufacturing the magnetic sheet of claim 1, the method comprising:

forming the different material layer on both surfaces or one surface of at least one of the plurality of green sheets;

stacking the plurality of green sheets on top of each other after forming the different material layer.

8. The method of claim 7, wherein the different material layer is formed by coating a paste obtained by mixing a different material powder with an organic solvent.

9. An antenna comprising:

the magnetic sheet of claim 1;

a first radiating material attached to a projection surface of the magnetic sheet corresponding to a region of the green sheet in which the first layer is formed; and a second radiating material attached to a projection surface of the magnetic sheet corresponding to a region of the green sheet in which the second layer is formed.

10. The magnetic sheet of claim 1, wherein said at least one surface on which the first layer and the second layer includes a region in which the different material layer is not formed, and the first layer and the second layer are spaced apart from each other by the region.

11. A magnetic sheet manufactured by stacking a plurality of green sheets on top of each other and calcining the stacked plurality of green sheets, wherein a different material layer is formed between two green sheets among the plurality of green sheets, and the different material layer comprises:

a first layer formed of a first component between said two green sheets, the first layer being in contact with said two green sheets; and a second layer formed of a second component between said two green sheets, the second layer being in contact with said two green sheets, wherein the first layer and the second layer do not overlap, and the first component and the second component are different from each other, wherein a region of the magnetic sheet in which the first layer is formed has a first permeability value adjusted by the first component, and a region of the magnetic sheet in which the second layer is formed has a second permeability value different from the first permeability value and adjusted by the second component.

12. The magnetic sheet of claim 11, wherein at least one of the first layer and the second layer includes a cobalt component.

* * * * *